United States Patent [19]

Burgess

[11] Patent Number: 5,044,823

[45] Date of Patent: Sep. 3, 1991

[54] RELATING TO SEALS

[75] Inventor: George H. Burgess, Maidstone, England

[73] Assignee: C.E. Heinke & Company Limited, England

[21] Appl. No.: 452,466

[22] Filed: Dec. 20, 1989

[30] Foreign Application Priority Data

Dec. 22, 1988 [GB] United Kingdom ..... 8830022

[51] Int. Cl.[5] ..... E21D 11/00; F16J 9/00

[52] U.S. Cl. ..... 405/152; 277/79; 277/34.6; 277/210; 277/215; 277/167.5

[58] Field of Search ..... 277/3, 27, 34, 71, 79, 277/167.5, 208, 210, 215, 34.6; 405/152

[56] References Cited

U.S. PATENT DOCUMENTS

| | | | |
|---|---|---|---|
| 51,945 | 1/1866 | Hewes | 277/34 |
| 3,338,583 | 2/1964 | Isdale | 277/34.6 |
| 3,815,926 | 6/1974 | Vore | 277/34 |
| 3,831,950 | 8/1974 | Bentley et al. | 277/209 X |
| 4,762,441 | 8/1988 | Glang | 405/152 |
| 4,797,032 | 1/1989 | Glang | 405/152 |
| 4,824,289 | 4/1989 | Glang et al. | 405/152 |
| 4,834,395 | 5/1989 | Benford | 277/95 |
| 4,900,607 | 2/1990 | Glang et al. | 405/152 X |
| 4,946,309 | 8/1990 | Glang | 405/152 |

FOREIGN PATENT DOCUMENTS

| | | |
|---|---|---|
| 0210326 | 3/1986 | European Pat. Off. . |
| 0255600 | 6/1987 | European Pat. Off. . |
| 2008692A | 6/1979 | United Kingdom . |
| 2017194A | 10/1979 | United Kingdom . |
| 2170561A | 8/1986 | United Kingdom . |
| 2178114A | 2/1987 | United Kingdom . |

*Primary Examiner*—William A. Cuchlinski, Jr.
*Assistant Examiner*—J. Folker
*Attorney, Agent, or Firm*—Nixon & Vanderhye

[57] ABSTRACT

A gap between tunnel segments 1 is sealed by rubber sealing members 8 that are provided with grooves 10 and tubular cavities 11. To improve sealing when a high pressure is applied to one side of the seal, at least one cavity nearest that side is open to the high pressure through apertures 12.

11 Claims, 1 Drawing Sheet

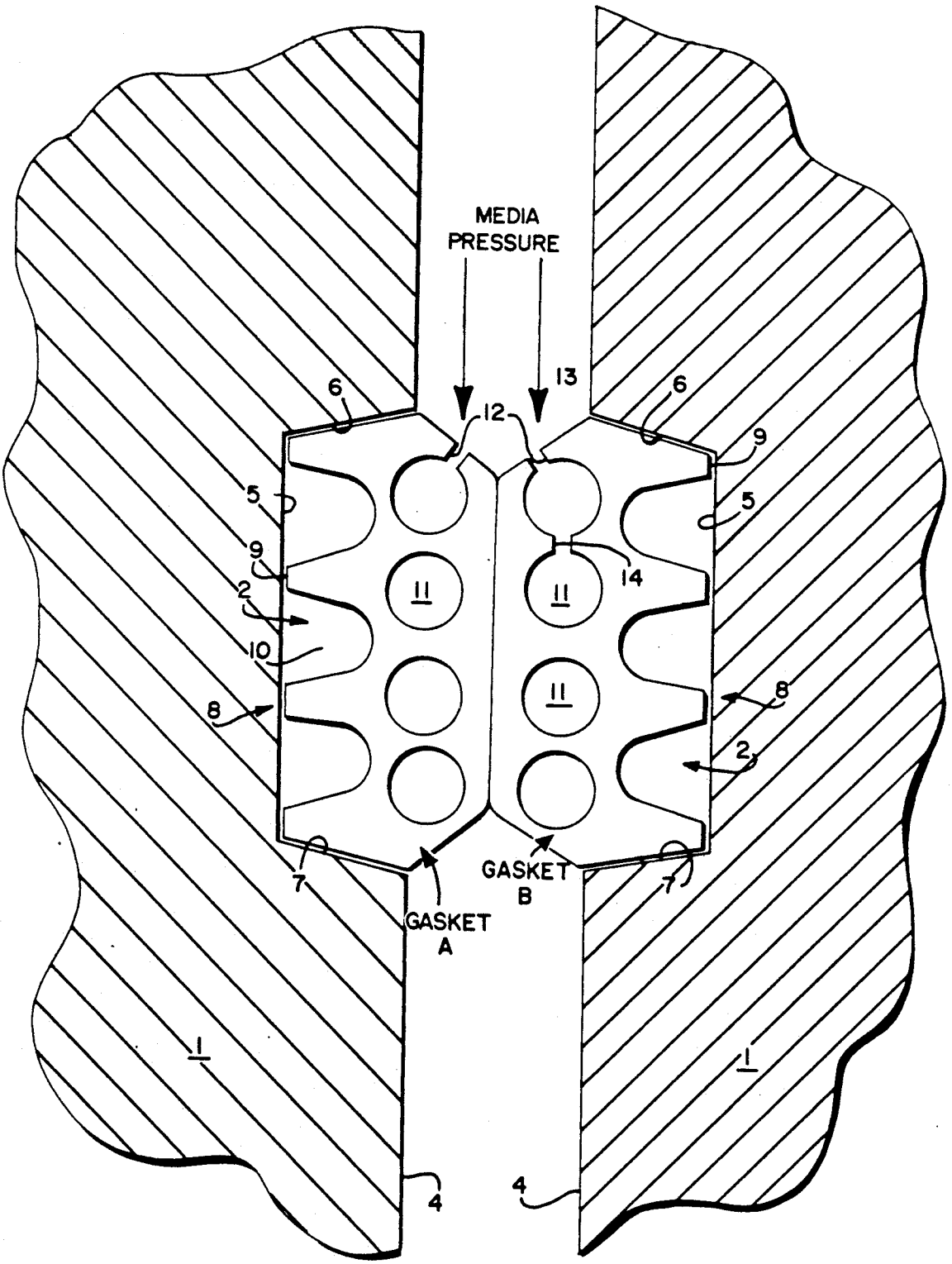
MEDIA
PRESSURE
13
12
6
6
9
5
5
9
14
2
10
8
8
2
7
7
GASKET
B
GASKET
A
1
1
4
4

RELATING TO SEALS

The invention relates to seals, and especially to a gasket for sealing a narrow gap between relatively fixed members, for example, between segments making up the wall of a tunnel or the like.

It has previously been proposed to provide in the edge faces of tunnel lining segments grooves in which are laid rubber gaskets. The gaskets project out of the grooves, and when adjacent segments are fastened together the gaskets on the two segments are pressed together and compressed, forming a seal between the segments. United Kingdom Patent Applications Nos. 2 170 561A and 2 178 114A disclose examples of previously proposed gaskets with a number of parallel grooves running along the face of the gasket that lies adjacent to the bottom of the groove in the tunnel segment, and a number of tubular cavities running along within the gasket between the parallel grooves and the face that abuts the gasket on the adjacent segment.

Under ideal conditions, the tunnel segments are exactly aligned and very close together, and the gaskets are compressed almost entirely into the grooves in the segments, with the grooves and cavities in the gaskets being greatly compressed. In practice, however, it sometimes occurs that there is a significant gap between the adjacent tunnel segments and/or the tunnel segments are out of alignment so that the gaskets do not bear squarely against one another, with the result that the gaskets are not highly compressed or are not highly compressed over their entire width. Under those conditions, it has been found that leakage occurs between a gasket and the bottom of the groove in the respective segment, or between the abutting faces of the gaskets on adjacent segments, if the pressure difference across the seal is very high, for example, when sealing water at pressures in excess of 1MPa.

The invention provides an elongate sealing member of resilient material having a lower portion to be placed in a groove in a member between which and another member a seal is to be formed, and an upper portion to project from such a groove, a plurality of longitudinal grooves in the bottom face of the sealing member and a plurality of longitudinal cavities within the sealing member, wherein at least one such cavity adjacent to a side of the sealing member is in communication with the exterior through that side of the sealing member at at least one point that in normal use, at least when the sealing member is not highly compressed, tends to be exposed to the medium on one side of the seal.

The invention also provides a gasket for a tunnel segment or the like consisting of a plurality of sealing members according to the invention joined together end to end in such a manner that the ends of the said cavities of each said sealing member are sealed.

The invention further provides a tunnel segment or the like having a continuous groove encircling it in the edge faces that abut adjacent segments when assembled, and a gasket according to the invention or an endless sealing member according to the invention seated in the endless groove with the said one cavity open to the exterior towards the side of the segment that will be exposed to the higher pressure in use.

The invention also provides a tunnel or the like assembled from such segments with their said sealing members pressed together.

It is believed that, when such a seal that is not fully compressed is exposed to a high pressure on the said one side, the ambient fluid penetrates into the said one cavity, tending to cause that cavity to expand and to compress the nearby groove or grooves in the bottom of the sealing member, increasing the pressure applied to, and improving the efficiency of the seal at, the interfaces between each sealing member and the base of the respective segment groove, and between the two sealing members.

It is preferred that between the cavity or cavities that are in communication with the exterior on the high-pressure side of the seal and the exterior on the low-pressure side of the seal, or any cavity in communication with the exterior on the low-pressure side, there should be a cavity that is not in communication with the exterior on either side, because with only a single cavity wall separating the high and low pressures there would be an increased risk of rupture of the seal. Preferably, any cavity immediately adjacent to the low-pressure side of the seal should not be in communication with the exterior. Subject to that, however, more than one cavity may be in communication with the exterior on the high-pressure side either directly or indirectly. For example, in a sealing member with four elongate cavities side-by-side it is preferred for two or even three to be in communication each with the next and the outermost with the exterior.

As materials for the sealing member, the natural and synthetic rubbers used for comparable previously proposed sealing members are generally satisfactory.

One form of sealing member constructed in accordance with the invention will now be described by way of example only with reference to the accompanying drawing, the single FIGURE of which is a cross-section through part of a joint between two tunnel segments.

Referring to the accompanying drawing, two tunnel segments 1 each have a generally rectangular, sectorial shape bounded by two planes containing the axis of the tunnel and two planes perpendicular to that axis. Each segment is encircled on its concave side by a radially inwardly extending flange, and adjacent segments are held together by bolts extending through their flanges. Such segments, usually of steel or concrete, and shafts, tunnels and the like constructed of such segments, are well known and, in the interests of conciseness, will not be further described here. Each segment 1 has a groove, indicated generally by the reference numeral 2, encircling it, along the edge faces 4 that face the adjacent segments. Each groove 2 has a flat bottom 5 and sloping sides 6 and 7, so that the groove is wider at the level of the edge faces 4 than it is at the bottom 5.

In each groove 2 lies a sealing gasket that consists of four lengths of extruded rubber sealing member indicated generally by the reference numeral 8, one for each of the edge faces 4, joined together at the corners by corner pieces cast on in manner that is known in the art. The sealing member 8 is adhesively bonded into the segment groove 2 in a manner known per se. The sealing member 8, in an uncompressed state, is generally in the shape of a flattened hexagon, half in and half out of the groove 2. In the underside 9 of each sealing member 8, lying on the bottom 5 of the groove 2, are three grooves 10, side-by-side and of roughly equal sizes. The mouths of the grooves 10 occupy over two thirds of the width of the underside 9, and are as deep as they are wide, which is rather less than the depth of the groove 2. In the upper portion of the sealing member 8, that is to say, the portion that when the sealing member is uncompressed projects from the groove 2, are four cylindrical cavities 11, approximately circular in cross-section, side by side and roughly evenly spaced The total volume of rubber in any given length of the sealing member 8 is slightly less than or equal to the volume of the same length of the segment groove 2, so that if the sealing members are compressed sufficiently the grooves 10 and cavities 11 will collapse substantially completely, allowing the faces 4 of the two segments 1 to meet.

The cavity 11 on the side of the seal that is to be exposed to the higher pressure in use (for example, the outside of a road or rail tunnel or the inside of a water main) is in communication with the exterior through apertures 12 at intervals along its length, which open out through an upper side wall portion 13 of the sealing member 8 on that side of the seal, above the level of the face 4. That cavity 11 may be in communication with the next cavity 11 through apertures 14, and the second cavity 11 may be similarly in communication with the third. The last cavity 11 is not in communication with the others, so that the high pressure fluid penetrating into the cavities is separated from the low pressure side of the seal by at least one sealed cavity 11 and the walls on either side of it.

In use, as shown in the drawing, adjacent segments 1 are secured together with the top surfaces of the sealing members 8 abutting A substantial gap may in practice be left between the edge faces 4 of the segments 1, so that the sealing members 8 are not strongly compressed and grooves 10 and cavities 11 are largely open. The side wall portions 13 of the sealing members 8 are then exposed to fluid under pressure penetrating through the gap between the faces 4 of the segments. The fluid can then penetrate through the apertures 12 and 14 into the cavities 11. Where the fluid pressure is high and the compression of the sealing members is not great, that is believed to lead to an increase in the internal pressure in, and consequently to expansion of, the cavities 11 in question, and that is believed to increase the compression of other parts of the sealing member and the contact pressure and sealing action at the interfaces between the rubber sealing members 8 and the steel or concrete segments 1.

As an example of suitable dimensions, in the case of a road or rail tunnel assembled from concrete segments about 750 mm by 1500 or 2000 mm, the groove 2 may be 8 mm deep and 26 mm wide at the bottom and 29 mm wide at the level of the segment face 4. The sealing member 8 may be about 15 mm high when uncompressed, and 22 mm wide at the top, and the rubber of which it is made may have a hardness in the range of from 50 to 80 Shore. The apertures 12 may be slots 10 mm long at 200 mm intervals. The assembly of the segments 1 may allow a maximum gap of 6 mm between the faces 4 and a maximum sideways offset of 10 mm between the abutting sealing members 8. The loading applied to the joint may be up to 100 kN/m. A seal using such gaskets under those conditions may then be capable of sealing water at a pressure of 2MPa when a similar gasket without the apertures 12 and 14 might have begun to leak at a pressure of 1MPa.

It will be appreciated that the invention can be applied to other forms of sealing member than that shown in the drawing, for example, to sealing members with other numbers of grooves 10 and cavities 11, or with two rows of cavities 11 one above the other.

What I claim is:

1. A sealing member for sealing a gap between two members to separate fluid media at different pressures, comprising:

an elongate member of elastic material having at least one cavity within it extending along its length, wherein at least one said cavity is in communication with the exterior at intervals along its length through a portion of the surface of the sealing member that is arranged, in use, to be exposed to the medium at the higher pressure, and is in communication with the exterior through only the said portion of the surface of the sealing member.

2. A sealing member as in claim 1 that is arranged, in use, to be seated in a groove in a surface defining one side of such a gap and that has at least one groove formed in a face that is to engage the bottom of the groove in the said surface.

3. A sealing member as in claim 1 that has a plurality of said cavities arranged side by side, at least one of which cavities is in communication with the exterior, but wherein at least one cavity immediately adjacent to a portion of the surface of the sealing member that is arranged in use to be exposed to a medium at lower pressure is in communication neither with the exterior nor with any other said cavity.

4. A sealing member as in claim 3 wherein at least two of the said cavities are in communication with the exterior.

5. A sealing member as in claim 1, which is of elastomeric material.

6. A sealing member as in claim 5 which is of rubber.

7. A sealing gasket comprising a plurality of sealing members as in claim 1 joined end to end in such a manner that the said cavities are sealed at the joints.

8. A segment for a hollow structure provided with an endless sealing member as in claim 1 arranged, in use, to abut corresponding gaskets or sealing members on adjacent segments.

9. A hollow structure assembled from segments as in claim 8.

10. A segment for a hollow structure provided with an endless sealing member gasket as in claim 7 arranged, in use, to abut corresponding gaskets or sealing members on adjacent segments.

11. A sealing member for use between two abutting static structural members which separate media under different respective pressures, said sealing member comprising:

a single unitary flexible body having plural closed cavities, at least one but not all of said cavities including an opening therein which communicates directly or indirectly with the exterior of said body at a location to be exposed in use to the higher pressure one of said media.

* * * * *